US009056708B2

(12) United States Patent
Smith

(10) Patent No.: US 9,056,708 B2
(45) Date of Patent: Jun. 16, 2015

(54) PRODUCT CUSHIONING DEVICE FOR PACKAGING SHOCK SENSITIVE PRODUCTS

(76) Inventor: Forrest Smith, Santa Anna, CA (US)

( * ) Notice: Subject to any disclaimer, the term of this patent is extended or adjusted under 35 U.S.C. 154(b) by 1386 days.

(21) Appl. No.: 12/324,078

(22) Filed: Nov. 26, 2008

(65) Prior Publication Data

US 2010/0126903 A1 May 27, 2010

(51) Int. Cl.
*B65D 85/30* (2006.01)
*B65D 81/05* (2006.01)

(52) U.S. Cl.
CPC ..... *B65D 81/05* (2013.01)

(58) Field of Classification Search
CPC ..... B65D 81/05; B65D 85/30
USPC ..... 206/589, 588, 592, 585, 562, 563, 486, 206/203, 490, 419, 422
See application file for complete search history.

(56) References Cited

U.S. PATENT DOCUMENTS

| | | | | |
|---|---|---|---|---|
| 3,203,540 | A * | 8/1965 | Kalt et al. | 206/569 |
| 4,114,761 | A * | 9/1978 | Kleiner | 206/591 |
| 5,203,540 | A * | 4/1993 | Lee | 254/8 B |
| 5,226,543 | A * | 7/1993 | Foos et al. | 206/592 |
| 5,320,226 | A | 6/1994 | Merrill | |
| 6,123,200 | A * | 9/2000 | Stephens et al. | 206/592 |
| 6,261,653 | B1 | 7/2001 | Smith | |
| 6,520,337 | B2 | 2/2003 | Smith | |
| 6,786,334 | B2 * | 9/2004 | Smith | 206/592 |
| 6,805,241 | B2 | 10/2004 | Smith | |
| 7,789,239 | B2 * | 9/2010 | Juliano | 206/564 |
| 2004/0055929 | A1 | 3/2004 | Smith | |
| 2008/0197037 | A1 | 8/2008 | O'Brien et al. | |

FOREIGN PATENT DOCUMENTS

| | | | |
|---|---|---|---|
| CN | 1449971 | A | 10/2003 |
| CN | 1978285 | A | 6/2007 |
| WO | 0153166 | A1 | 7/2001 |

* cited by examiner

*Primary Examiner* — Anthony Stashick
*Assistant Examiner* — Raven Collins
(74) *Attorney, Agent, or Firm* — Laubscher, Spendlove & Laubscher, P.C.

(57) ABSTRACT

Disclosed is a product cushioning device for supporting a shock sensitive product during shipping, said product cushioning structure being made of a moldable resilient plastics material. The device comprises a plurality of device surfaces suitably shaped and sized to accommodate the shock sensitive product, one of the plurality of device surfaces including a product supporting region at least partially surrounded by product contacting walls, and having a product supporting platform in the lower region thereof; and a three-dimensional structural feature formed into a least one of the plurality of device surfaces; wherein the three-dimensional structural feature serves to control the amount and rate of deflection in the event of impact. In one embodiment, the three-dimensional structural feature comprises a plurality of lines of weakness in a projecting part protruding from at least one device surface being formed of a male mold, wherein in use a top portion of the projecting part rests against the product. In another embodiment, the three-dimensional structural feature comprises at least one donut shaped cavity in the product receiving cavity. Also disclosed is a method of making a product cushioning device in accordance with the teachings of this invention.

14 Claims, 8 Drawing Sheets

PRODUCT CUSHIONING DEVICE FOR PACKAGING SHOCK SENSITIVE PRODUCTS

FIELD OF THE INVENTION

The present invention relates to product cushioning devices for use in packaging shock sensitive products such as various types of electronics. More specifically, the present invention relates to a unitary cushioning device which may be molded from a plastics material using a variety of molding techniques.

BACKGROUND OF THE INVENTION

The use of product cushioning devices for shock sensitive products has been known for many years. Such devices are used for protecting the shock sensitive products in the event that they are dropped or mishandled during shipping. Some examples of product cushioning devices include tissue paper, shredded paper, bubble-pack and molded foamed polystyrene pellets.

As the requirement for better packaging and cushioning became more demanding, for example with the introduction to the market of complicated and expensive electronics such as hard drives, printed circuit boards, and the like, the requirement arose for more sophisticated and better shock absorbing cushioning devices.

Cost, of course, plays a role in the manufacture of such cushioning devices as well. It is in a manufacturer's best interest to keep costs as low as possible. Typically, molding techniques producing a unitary cushioning device may be more efficient and thus less expensive. Molding techniques allow one to create devices formed of a resilient plastics material in a variety of different shapes and sizes as may be desired depending on the application and use of the finished device.

However, present molding techniques, such as thermo-forming, give rise to some problems during manufacture of the device. A typical thermo-forming machine has a male or female die or mold. The use of these basic molds permits shaping of the plastics sheet into various desirable shapes and sizes (depending on the product to be packaged and the outer packaging container). There will also be a choice regarding the material used as well as the thickness of the plastic material used. The decision is determined based on the end purpose to which the unitary product cushioning device will be put. These design parameters will produce product cushioning devices of various forms, each with some inherited differences. These differences create fundamental characteristics of various parts of the final product, some of these characteristics being advantageous, but some being quite disadvantageous.

In particular, the compression strength of the molded unitary device, and thereby its ability to withstand shock forces may vary as a function of these design parameters. For example, an uneven distribution of material resulting in a device with thin sides is especially problematic if the packaged product is subjected to impact, such as impact that can occur during shipping. Such impact can have a detrimental effect on the shock sensitive product, resulting in damage or breakage of the product.

Thus is it desirable to provide a unitary product cushioning device for protecting shock sensitive products during shipping that can be molded from a resilient plastics material.

SUMMARY OF THE INVENTION

A unitary product cushioning device formed from a sheet of resilient plastics material is disclosed. The present inventor has discovered a way to successfully produce a molded product cushioning device exhibiting desirable compressability characteristics.

A problem the present inventor routinely encountered was that certain final molded shapes do not impart desirable deflection-strength and/or rigidity required to fully protect a shock sensitive device in the event of impact. Final molded shapes can be either too hard or too soft. However, the inventor has discovered a way to introduce three dimensionality and stiffness to reduce the potential of damage or breakage to the shock sensitive product.

Broadly, the device in accordance with the teachings of this invention comprises a product cushioning device for supporting a shock sensitive product during shipping, said product cushioning structure being made of a moldable resilient plastics material. The device comprises a plurality of device surfaces suitably shaped and sized to accommodate the shock sensitive product, one of the plurality of device surfaces including a product supporting region at least partially surrounded by product contacting walls, and having a product supporting platform in the lower region thereof; and a three-dimensional structural feature formed into a least one of the plurality of device surfaces; wherein the three-dimensional structural feature serves to control the amount and rate of deflection in the event of impact.

In one embodiment, the device further comprises a projecting part protruding from at least one device surface being formed of a male mold, wherein in use a top portion of the projecting part rests against the product. The three-dimensional structural feature may comprise a plurality of lines of weakness in the top portion of the projecting part.

In one embodiment, the device further comprises a post structure protruding from the product support region and being formed of a female mold resulting in a relatively thin walled structure; and a wing hingedly connected to at least one side of the product supporting region; and wherein the projecting part protrudes from a device surface in the wing. The post structure may be substantially in the form of a rounded triangle and the projecting part is in the form of a rounded cylindrical dome. The post structure may define an air space therein to provide a crushing mechanism upon impact.

In one embodiment, a pair of said product cushioning devices are employed, one at each end of the shock sensitive product, said product cushioning device further comprising: a product receiving cavity surrounded by product contacting walls, and having a product supporting platform in the lower region thereof; and a base portion below said product receiving cavity, having at least one pair of deflection elements extending diagonally away from the corners of said product receiving cavity towards external outer packaging container contacting corners, wherein said pairs of deflection elements are adapted to control deflection another under shock loading conditions. The three-dimensional structural feature may comprise at least one donut shaped cavity in the product receiving cavity. The donut shaped cavity may comprise an outer wall, and inner wall which is lower in height that the outer wall.

In another aspect, the invention provides a method of making a product cushioning device for supporting a shock sensitive product during shipping, said unitary product cushioning device being made of moldable resilient plastics material, comprising molding a plurality of device surfaces suitably shaped and sized to accommodate the shock sensitive product, one of the plurality of device surfaces including a product supporting region surrounded by product contacting walls, and having a product supporting platform in the lower region thereof; and molding a three-dimensional feature formed into a least one of the plurality of device surfaces; wherein the three-dimensional feature serves to control the amount and rate of deflection. The product cushioning device may be a unitary device formed of a single sheet of plastics material.

There are many advantages in using a unitary cushioned packaging in accordance with the teachings of this invention. Most notably, the present inventor has discovered a way to produce such a device that has the desired characteristics of both the male and female molded parts regardless of the geometry (shape and size) of the required end product cushioning device. Broadly, the inventor has discovered that by introducing a three-dimensional structural feature into a least one of the plurality of device surfaces provides points of deflection in the event of impact, thus protecting the shock sensitive product being shipped.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein:

FIGS. 6*a*, 6*b*, 6*c* and 6*d* illustrate another particular embodiment of a unitary product cushioning device in accordance with the present invention, wherein FIG. 6*a* is a perspective view, FIG. 6*b* is a top view, FIG. 6*c* is an upside down view of FIG. 6*b*, and FIG. 6*d* is a side view;

FIGS. 7*a*, 7*b*, 7and 7*d* illustrate illustrate another particular embodiment of a unitary product cushioning device in accordance with the present invention, wherein FIG. 7*a* is a perspective view, FIG. 7*b* is a top view, FIGS. 8*a*, 8*b*, 8*c* and 8*d* illustrate another particular embodiment of a unitary product cushioning device in accordance with the present invention, wherein FIG. 8*a* is a perspective view, FIG. 8*b* is a top view, FIG. 8*c* is an upside down view of FIG. 8*b* and FIG. 8*d* is a side view.

Figure 1:
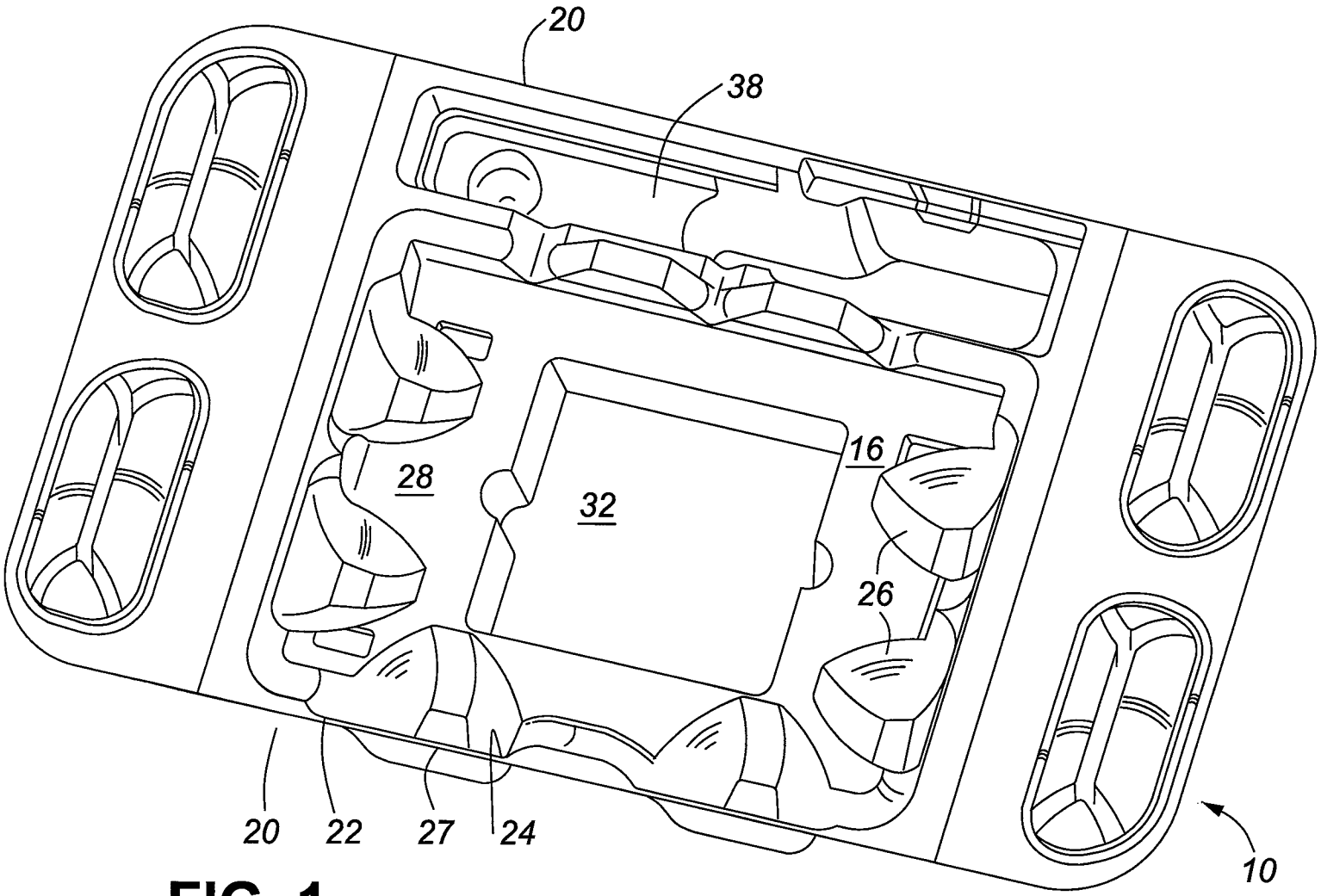
FIG. 1 illustrates one particular embodiment of a unitary product cushioning device in accordance with the present invention.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like recited. It will be understood that any illustrated dimensions are exemplary only.

DETAILED DESCRIPTION OF THE DISCLOSED EMBODIMENTS

A product cushioning device in accordance with the teachings of this invention has many different possible configurations. Different embodiments of two such configurations are detailed below. However firstly a fundamental overview of a product cushioning device in accordance with the teachings of this invention is provided to explain some characteristics found in all embodiments.

Broadly, teachings of the invention provide a unitary product cushioning device for supporting a shock sensitive product. In one embodiment, the unitary product cushioning device is placed in an outer packaging container (not shown) during shipping. In another embodiment, the unitary product cushioning device is not placed in an outer packaging container, but is shrink wrapped during shipping. Said unitary product cushioning structure is made of a moldable resilient plastics material. The device comprises a plurality of device surfaces suitably shaped and sized to accommodate the shock sensitive product and outer packaging container (if used), one of the plurality of device surfaces including a product supporting region at least partially surrounded by product contacting walls, and having a product supporting platform in the lower region thereof. A three-dimensional structural feature is formed into a least one of the plurality of device surfaces, wherein the three-dimensional structural feature provides resistance to deflection to control the rate of deflection in the event of impact. The three-dimensional structural feature is configured to maximize deflection without bottoming out.

Typically, unitary product cushioning structures in keeping with the present invention are thermoformed or vacuum formed, but they might in some circumstances be molded using other plastics molding techniques such as injection molding or blow molding or rotational molding. The various ways the product cushioning device can be formed from resilient plastics material, including choices between various design considerations are known and are not detailed here.

As mentioned above, molding techniques give rise to some differences in characteristics of various parts or surfaces of the final device, some of these characteristics being advantageous, but some being quite disadvantageous. Such inherent characteristics must be taken into account when producing a device to be used for packaging shock sensitive products. Particularly when a product cushioning structure is thermoformed from plastics material, the compression strength of the molded unitary structure, and thereby its ability to withstand shock forces, may vary as a function of the thickness of various parts or surfaces of the final device. For example, it is commonly known that a part made from a female mold will result in thinning of the plastics sheet. The deeper the cavity of the female part, the thinner the resulting part will be. In contrast male molds use a protrusion to shape the plastics sheet. It is commonly understood that the top or highest portion of the formed part will retain a thickness closest to that of the original plastics sheet.

The present inventor has discovered a way to produce such a device that has the desired characteristics of both the male and female molded parts regardless of the geometry (shape and size) of the required end product cushioning device.

The present inventor has found that certain final molded shapes do not impart desirable deflection-strength and/or rigidity required to fully protect a shock sensitive device in the event of impact. Final molded shapes can be either too hard or too soft. However, the inventor has discovered that the introduction of suitable three-dimensional structural features to strategic device surfaces can provide requisite three dimensionality and stiffness to reduce the potential of damage or breakage to the shock sensitive product.

As such, in each configuration and embodiment of a product cushioning device in accordance with the teachings of this invention include a three-dimensional structural feature formed into a least one of the plurality of device surfaces, wherein the three-dimensional structural feature serves to control the resistance to deflection.

Figure 2:
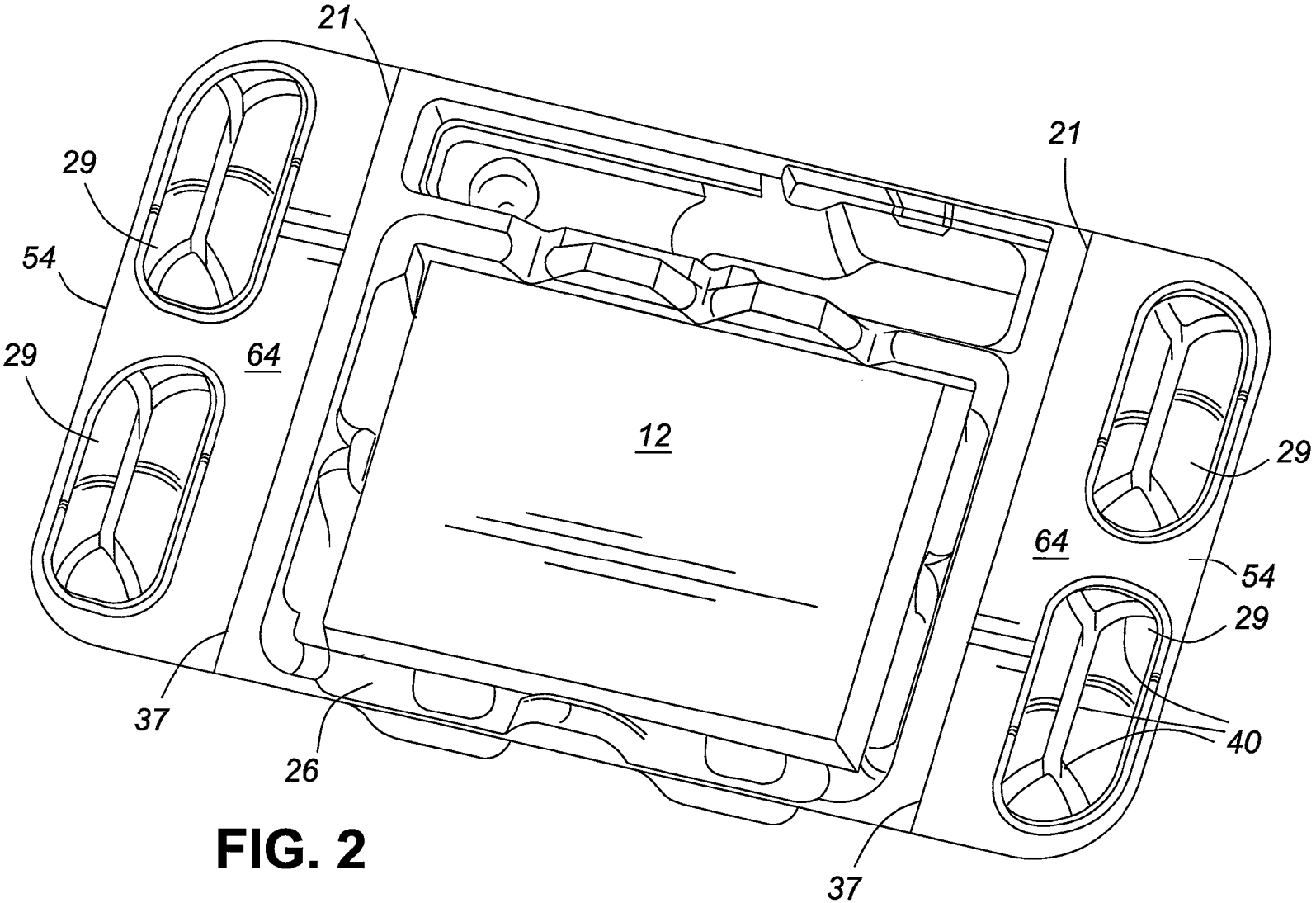
FIG. 2 illustrates the unitary product cushioning device of FIG. 1 with a shock sensitive product packaged therein.
Figure 3:
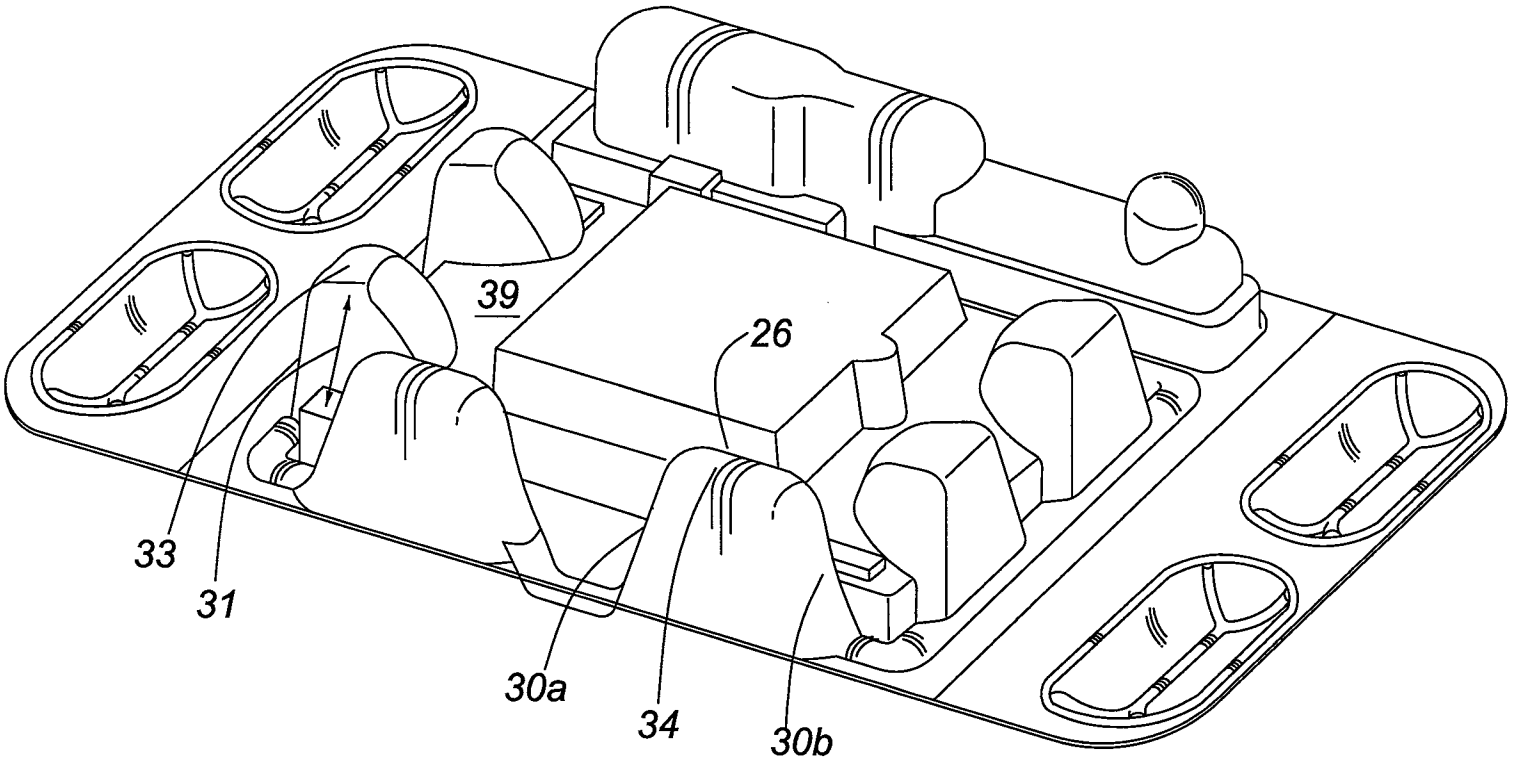
FIG. 3 illustrates an upside down view of the unitary product cushioning device of FIG. 1.

Reference will now be made to FIGS. 1 to 3, where one particular configuration of a unitary product cushioning device in accordance with the present invention is illustrated. Broadly described, a product cushioning device 10 in accordance with teachings of this invention is made of a single sheet of moldable material formed to provide a product support region 16 for receiving and cushioning a product to be packaged (not shown). In this case, the product cushioning device 10 is particularly suitable for shipping a laptop 12. The device 10 comprises at least a pair of outer walls in opposed relation. In the case where an outer packaging container is used, edges 20 contact the walls of the outer container. In the upper region of the unitary product cushioning device 10, there is a product supporting region 16. It is bounded and defined by at least a pair of inner product contacting walls 24, a pair of outer product supporting region defining wall 22 and an upper ridge 27 therebetween. Also each of the outer edges 20 has a bottom edge 39 which provides an outer packaging container contacting surface if/when placed into a container.

The lower portion of the main product supporting region 16 terminates in a product receiving platform 28. The product receiving platform 28 is generally perpendicular to the orientation of each outer edge 20. However, in other embodiments, the product receiving platform may be another shape as may be desired based on the particular use or application.

Figure 4:
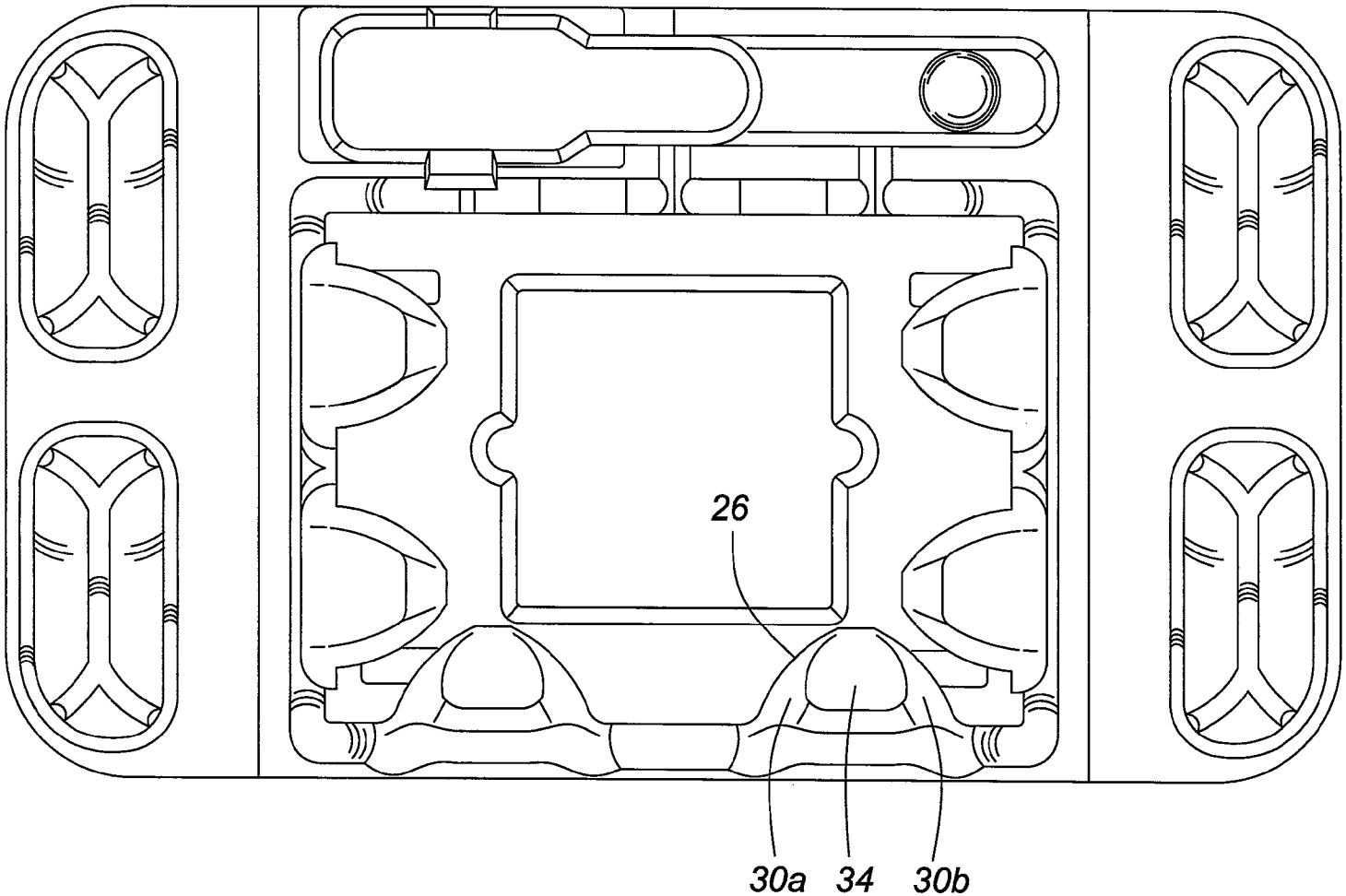
FIG. 4 is a top plan view of the unitary product cushioning device of FIG. 1.

Referring to FIG. 4, the product receiving platform 28 comprises a plurality of molded parts 26. Parts 26 project generally vertically away from the main product support region 16. In this embodiment, the parts 26 comprise post structures that function to provide a shock absorbing air space therein. Each post structure 26 has a pair of sidewalls 30*a* and 30*b* and a closed end 34. The post structure 26 may substantially be formed having the cross-section of a triangle as illustrated. Alternatively, the post structure 26 could be any suitable shape, such as cone-shaped or rectangular with round corners.

During forming, the post structures 26 are molded using a female portion of the mold. As a result, the sidewalls 30*a* and 30*b* are relatively thin, reaching a maximum thinness/minimum thickness at the closed end 34. If a shock load is applied to the unitary product cushioning device 10 in a direction towards the bottom planar surface 28, then the post structure 26 will temporarily be deflected to absorb the impact force due to the relative thinness of the structure.

Between an outer edge 20 and the respective outer product supporting region defining wall 22, there could be an accessory holder 38. The size and shape of the accessory holder 38 can vary as needed. The product receiving platform 28 may also include a CD holder 32.

It has been noted that product receiving platform 28 is formed with a plurality of post structures 26. Each of the post structures 26 extends in a direction away from the product receiving platform 28 to a lower extent limit 33. The vertical distance between the plane of the bottom edges 39 and the plane of the lower extent limit 33 defines a void 31 to provide additional shock absorbing protection. The angle of the walls 30*a* and 30*b* of post structure 26 can control the rate of compression during impact.

Generally parallel side edges 21 surrounding the product support region 16 are provided with integrally formed hinged wings 54. Each wing 54 includes a plurality of parts 29 that project outwardly from the inner flap surface 64. During shipping, the wings 54 fold over the product to cover and provide protection to the top of the packaged product. To facilitate folding of the wings 54 towards main product support region 16, hinges 37 are provided at the side edges such as to facilitate the upward folding of each wing 54.

Most notably, the product cushioning device provides a crushing mechanism to absorb shock during shipping and handling. The present inventor has found a way to provide such crushing mechanism into the product cushioning device 10 while still being able to produce a unitary device formed of a resilient plastics material as is described in detail below.

Figure 5:
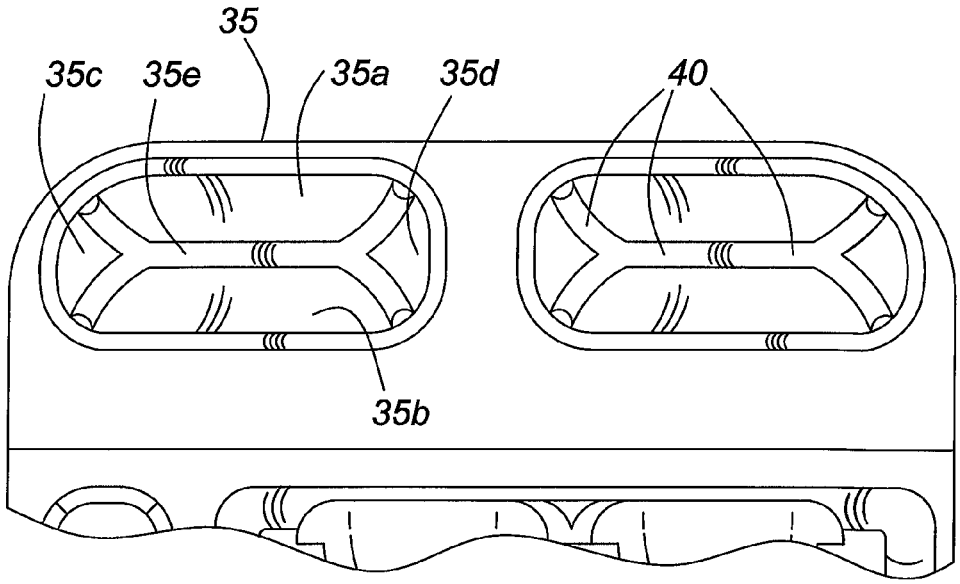
FIG. 5 illustrates a projecting part used in the unitary product cushioning device of FIG. 1.
Figure 6A:
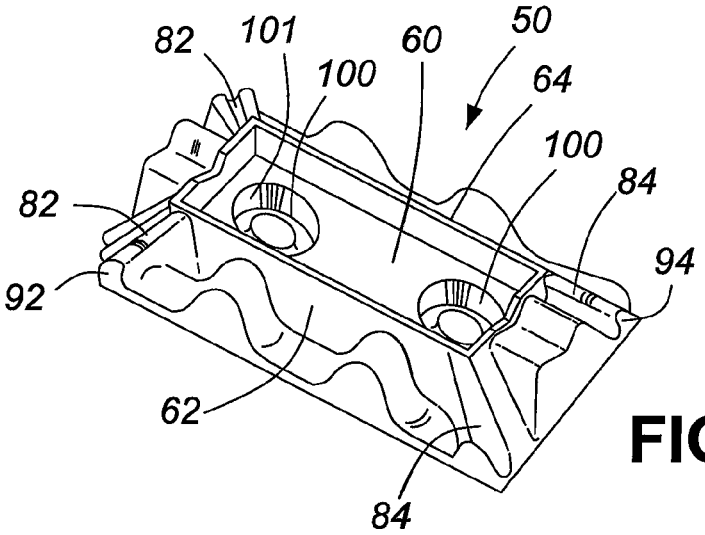
Figure 6B:
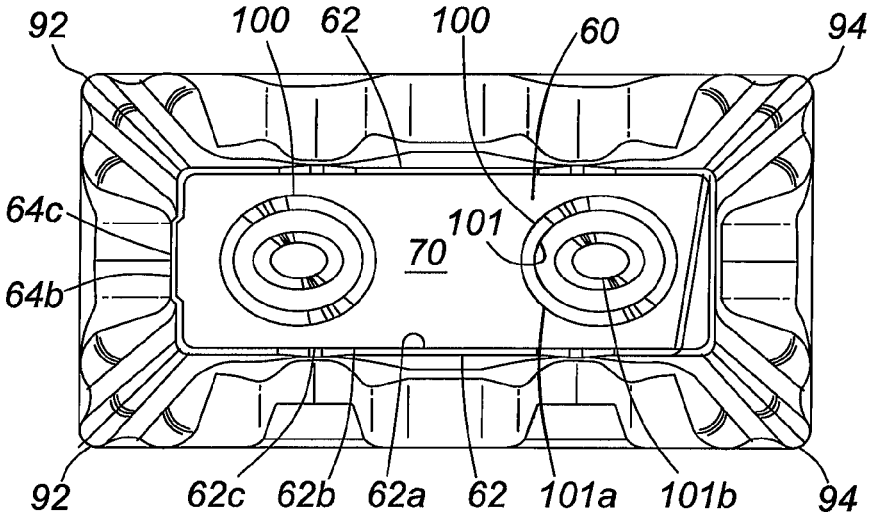
Figure 6D:
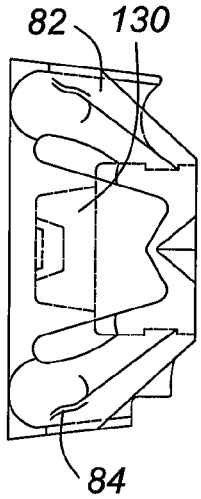
Figure 6C:
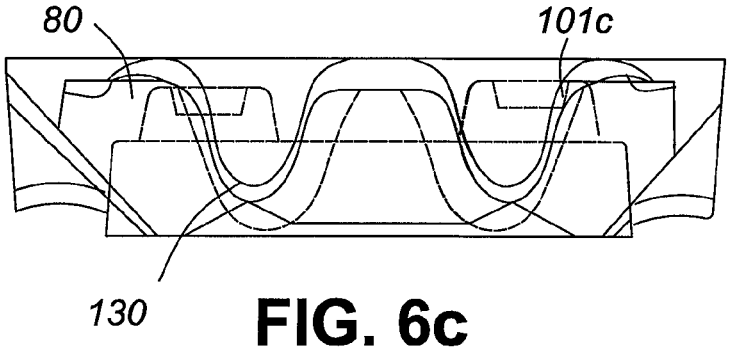
Figure 7A:
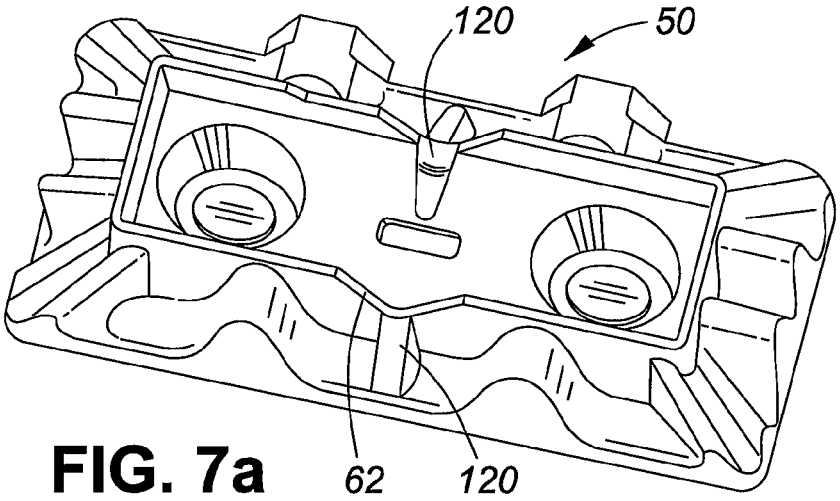
Figure 7B:
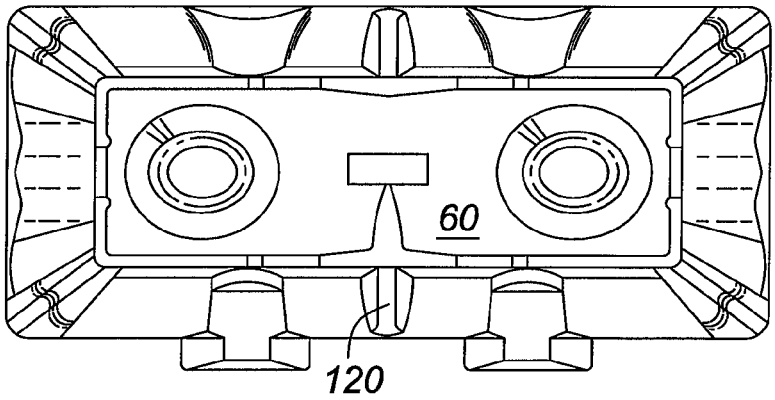
Figure 7D:
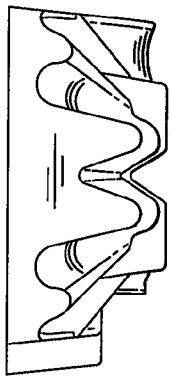
FIG. 7*c* is an upside down view of FIG. 7*b* and FIG. 7*d* is a side view.
Figure 7C:
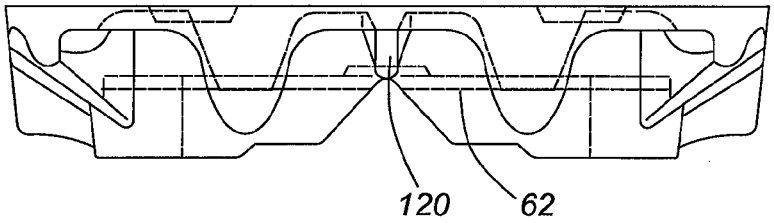
Figure 8A:
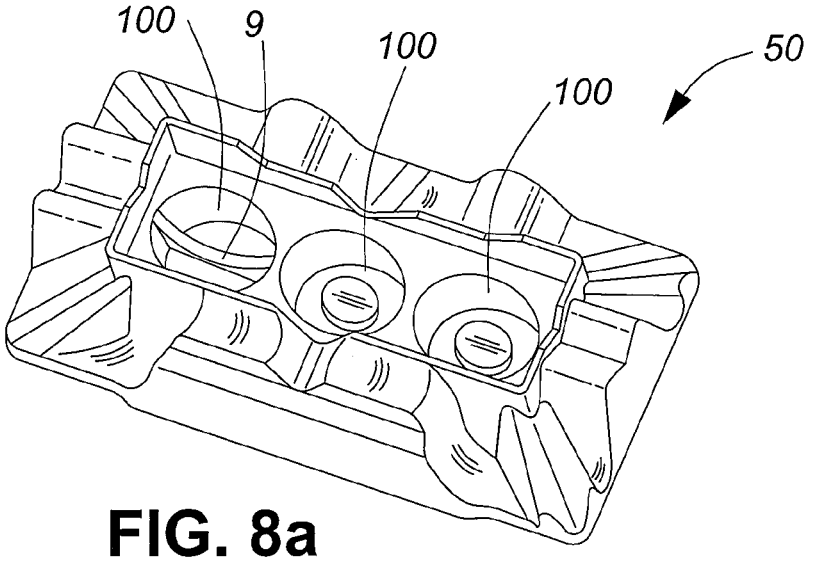
Figure 8B:
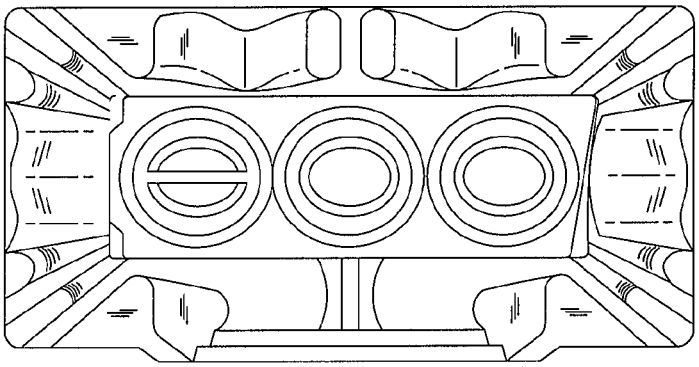
Figure 8D:
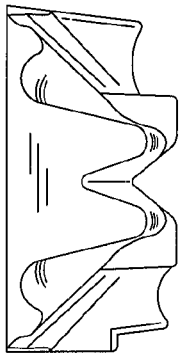
Figure 8C:
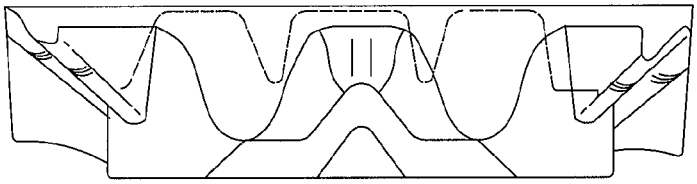

Referring to FIG. 5, in the illustrated embodiment, each projecting part 29 is in the form of a rounded cylindrical dome 35, having four sidewalls 35*a*, 35*b*, 35*c*, 35*d* meeting at a top portion 35*e*. However, the shape of the projecting part 29 is dependent upon design considerations, such as the size and shape of the product to be shipped. Other examples of suitable shapes include triangular or rectangular. In use, it is desirable that the rounded cylindrical domes 35 also be able to deflect in the event of impact to absorb the force. These rounded cylindrical domes 35 are formed using male mold. However, as is commonly known, such parts thermoformed using a male mold are relatively thick and are too rigid to deflect upon impact. The present inventor has found a way to solve this problem and provide device surfaces that will deflect and absorb impact force.

Broadly, as mentioned above, the inventor has discovered that by introducing a three-dimensional structural feature into a least one of the plurality of device surfaces provides a points of deflection in the event of impact. In this embodiment, the top portion of each cylinder structure has integrated therein lines of weakness 40. The lines of weakness 40, in the illustrated configuration, include a single line extending down the middle of the surface 35*e* and extending diagonally towards respective corners of the projecting part 29. Each line of weakness 40 is directly formed during the thermoforming process and provides a means to create a point of deflection in the case of impact. In the event of impact during use, the domes 35 with the lines of weakness 40 will collapse into itself, thus protecting the shock sensitive product. The rate of deflection can be adjusted by controlling the depth and angle of the lines of weakness 40.

The product cushioning device may also include a lid, which is a thermoformed, generally planar panel also provided with ribs. The lid is especially useful in embodiments of the device 10 wherein the wings 54 do not meet in the middle of product support region 16 to completely enclose the area. Alternatively, a lid may be used in place of the wings 54. When the lid is placed over the packaged products in the outer packaging container, the lid will provide a further protection to areas over the product support region 16 that the wings 54 do not cover.

It should be appreciated that the size (width, height and length) and shape of the product cushioning device 10 may vary depending on the particular application and the dimensions of the corresponding outer packaging container (if used) and shock sensitive device to be packaged. As such, another example is given below.

A product cushioning device 50, as can be understood from FIGS. 6*a*, 6*b*, 6*c* and 6*d*, has a general configuration of an end cap, in that it is intended to fit over the end of a shock sensitive product (not shown). It will also be understood that this unitary product cushioning device 50, in keeping with the present invention, is also intended to be used in conjunction with an outer packaging container as known in the art and previously discussed.

The unitary product cushioning device 50 has a product receiving cavity 60, which has a generally rectilinear configuration. The product receiving cavity 60 is defined by pairs of opposed product contacting walls 62/64, comprising inner walls 62*a* and 64*a*, and outside walls 62*c* and 64*c*. Joining walls 62*a* and 64*a* to walls 62*c* and 62*c*, respectively are ridges 62*b* and 64*b*. As shown, the shock sensitive device has a rectangular configuration, but may also have a square or circular configuration. Thus, it can be well understood that for such rectilinear shock sensitive devices, a pair of end caps or unitary protective packaging devices 50 in keeping with present invention can be employed together with an outer packaging container for shipping and storing the shock sensitive product (not shown).

The product receiving cavity 60 terminates at its bottom end by a product supporting platform 70 appropriately shaped to accommodate the shock sensitive product.

Below the product receiving cavity 60 there is a base portion 80. The base portion 80 can have one or more deflection elements 82 and 84 in the form of ribs extending diagonally away from a respective salient corner of the product receiving cavity 60. Alternatively, two pairs of deflection elements could also be used. Each of the deflection elements 82 and 84 is defined at its outer end by a respective external corner 92 or 94. The corners 92 and 94 fit into the corners of the outer packaging container.

At least one or a plurality of upwardly directed stiffening ribs 130 may also be formed in the unitary protective packaging device 50, particularly in base portion 80 between said external outer packaging container contacting corners in each of at least one pair of opposed sides of said base portion.

In accordance with the teachings of the present invention, the product cushioning device 50 also includes at least one three-dimensional structural feature. In the embodiment shown, these include donut shaped cavities 100 in product receiving cavity 60. The donut shapes 100 in the cavity 60 are used to provide shock protection when there is limited cushion room or a heavy shock sensitive product. The angle of the vertical walls 101 and the height of the donut hole 100 are used to adjust the stiffness of donut shapes 100. The vertical walls 101 comprise outer wall 101*a* and inner wall 101*b* joined by ridge 101*c* forming a central mesa. Inner wall 101*b* is lower in height than outer wall 101*a*.

In the event of impact, the shock sensitive product starts to crush the outer wall 101*a* of the donut shape 100, but once that gives way, the inner wall 101*b* of the donut shape 100 comes into play. This configuration provides a primary stage cushion and a secondary stage cushion which activates once the primary gives way. The impact needed to activate the secondary is controlled by the depth below the surface of the cavity bottom. For example, if the product is relatively heavy, the height difference is about 10 percent so that there is greater strength resisting impact.

As seen in the embodiment of FIGS. 7*a*, 7*b*, 7*c* and 7*d*, a pair of ribs 120 may be formed in the product contacting walls 62 of the product receiving cavity 60. The ribs 120 provide increased stiffness to the product contacting walls 62.

The embodiment of FIGS. 8*a*, 8*b*, 8*c* and 8*d* is also an end cap, but in this embodiment, three donut shapes 100 are used. It is also contemplated to include an additional rib 9 in one or more of the donut shapes to add strength.

A product cushioning device (such as product cushioning devices 10/50) in accordance with the teachings of this invention is preferably formed from a single sheet of plastic by thermoforming, injection molding or equivalent technology. Typical materials from which unitary product cushioning devices of the present invention may be molded include low density polyethylene, high density polyethylene, polyvinylchloride, PET, polystyrene, nylon, polypropylene, and appropriate mixtures and co-polymers thereof. However, it will be understood that the above list of materials is intended to be illustrative but not exhaustive. A preferred material for forming the device is polyethylene (PE).

When the unitary product cushioning device in accordance with the teachings of the present invention is thermoformed from a sheet of plastics material, the compression strength of the molded unitary structure and thereby its ability withstand shock forces may vary as a function of the thickness of the thermoformable sheet plastic material, from which the molded unitary product cushioning structure has been thermoformed. The preferred thickness of the original plastics sheet is 0.03 to 0.15.

It should be noted that the nature of the shock sensitive product is immaterial to the operation and function of the present invention. Typically, embodiments of this invention are particularly suitable for the packaging of laptop computers. Other products might be assembled computer cases and other assembled electronic products of all sorts, and other manufactured fragile products made of glass or ceramics, for example.

It has been noted above that a purpose of the product cushioning device in accordance with the teachings of the present invention, in any embodiment, is to provide shock absorbing protection for a shock sensitive product during shipping. It has been described that any product cushioning structure in keeping with the present invention is formed of a moldable resilient plastics material. Preferably, the product cushioning device is a unitary device formed from a single sheet of plastics material. Factors affecting the compression strength of the molded unitary product cushioning structures of the present invention are determined by the introduction of a three-dimensional structural feature formed into a least one of the plurality of device surfaces, wherein the three-dimensional structural feature has a suitable shape, angle and depth to control the rate of deflection upon impact.

It will be noted that the compression strength of the product cushioning device itself may vary as a function of the exact configuration of the three-dimensional structural feature. In any event, it is a purpose of the product cushioning structure to provide shock absorption protection in at least two of three mutually perpendicular directions. In its broadest sense, the present invention is adapted to provide shock absorption support for a product during shock loading conditions.

To that end, drop tests on a product cushioning device in accordance with the teachings of this invention have indicated the ability to meet all drop test standards. Those standards vary from case to case, depending on the product to be protected, the size and nature of the product cushioning structure, the nature of the outer packaging container, and so on.

Numerous modifications may be made without departing from the spirit and scope of the invention as defined in the appended claims.

What is claimed is:

1. A product cushioning device for supporting a shock sensitive product during shipping, said product cushioning structure being made of a moldable resilient plastics material, comprising:

a product-supporting region suitably shaped and sized to accommodate the shock sensitive product and at least partially surrounded by product contacting walls, and said product-supporting region having a product supporting platform in the lower region thereof; and at least one donut-shaped cavity with inclined walls defining a central mesa formed in the product supporting platform and serving to control the amount and rate of deflection in the event of impact, said central mesa having a height less than said donut-shaped cavity;

a base portion having salient outer corners for fitting into corresponding corners of an outer packaging container; and deflection elements in the form of inclined ribs extending from respective corners of the product-supporting region to corresponding salient outer corners of the base portion, wherein said deflection elements are adapted to control deflection under shock loading conditions.

2. The product cushioning device of claim 1, further comprising: a projecting part protruding from at least one device surface being formed of a male mold, wherein in use a top portion of the projecting part rests against the product.

3. The product cushioning device of claim 2, wherein the three-dimensional structural feature comprises a plurality of lines of weakness in the top portion of the projecting part.

4. The product cushioning device of claim 2, further comprising: a post structure protruding from the product support region and being formed of a female mold resulting in a relatively thin walled structure; and a wing hingedly connected to at least one side of the product supporting region; and wherein the projecting part protrudes from a device surface in the wing.

5. The product cushioning device of claim 4, wherein the post structure is substantially in the form of a rounded triangle and the projecting part is in the form of a rounded cylindrical dome.

6. The product cushioning device of claim 4, wherein the post structure defines an air space therein to provide a crushing mechanism upon impact.

7. The product cushioning device of claim 2, wherein the projecting part defines an air space therein to provide a crushing mechanism upon impact.

8. The product cushioning device of claim 3, wherein the product supporting region is flanked on two sides by two wings.

9. The product cushioning device of claim 1, wherein a pair of said product cushioning devices are employed, one at each end of the shock sensitive product.

10. The product cushioning device of claim 1, wherein the at least one donut shaped cavity comprises an outer wall and an inner wall which is lower in height than the outer wall.

11. The product cushioning device of claim 10, wherein the at least one donut shaped cavity includes a rib formed therein.

12. The product cushioning device of claim 10, wherein a downwardly directed rib is formed in at least one product contacting wall.

13. The product cushioning device of claim 1, wherein an outwardly directed stiffening rib is formed in said base portion between said outer corners of the base portion in each of at least one pair of opposed sides of said base portion.

14. The product cushioning device of claim 1, wherein the product cushioning device is a unitary device formed of a single sheet of plastics material.

* * * * *